US005197494A

United States Patent [19]

Kramer

[11] Patent Number: 5,197,494

[45] Date of Patent: Mar. 30, 1993

[54] TOBACCO EXTRACTION PROCESS

[75] Inventor: Anatoly I. Kramer, Winston-Salem, N.C.

[73] Assignee: R.J. Reynolds Tobacco Company, Winston-Salem, N.C.

[21] Appl. No.: 709,959

[22] Filed: Jun. 4, 1991

[51] Int. Cl.[5] ..... A24B 15/18

[52] U.S. Cl. ..... 131/298; 131/297

[58] Field of Search ..... 131/296-298, 131/900

[56] References Cited

U.S. PATENT DOCUMENTS

| | | | |
|---|---|---|---|
| 3,095,882 | 7/1963 | Hind et al. . | |
| 3,144,871 | 8/1991 | De Souza et al. . | |
| 3,398,754 | 8/1968 | Tughan . | |
| 3,803,004 | 4/1974 | Egri | 131/297 X |
| 4,506,682 | 3/1985 | Muller . | |
| 4,727,889 | 3/1988 | Niven et al. . | |
| 4,756,318 | 7/1988 | Clearman et al. . | |
| 4,862,905 | 9/1989 | Green . | |
| 4,887,618 | 12/1989 | Bernasek et al. . | |
| 4,967,771 | 11/1990 | Fagg et al. . | |
| 4,986,286 | 1/1991 | Roberts et al. . | |

FOREIGN PATENT DOCUMENTS 388831 10/1989 European Pat. Off. .

OTHER PUBLICATIONS

Hubert et al., "Fluid Extraction of Hops, Spices and Tobacco with Supercritical Gases", Angew. Chem. Int. Ed. Engl. 17, pp. 710-715 (1978).

Recent Developments In Low Temperature Steam Distillation Of Hop Oil, J. A. Pickett; vol. 83, pp. 302-304, J. Inst. Brew, Sep.-Oct., 1977.

Nectarine Volatiles: Vacuum Steam Distillation versus Headspace Sampling, Gary R. Takeoka; pp. 553-560, J. Agric. Food Chem. 1988.

*Primary Examiner*—V. Millin
*Assistant Examiner*—J. Doyle
*Attorney, Agent, or Firm*—Bell, Seltzer, Park & Gibson

[57] ABSTRACT

The present invention relates to a process for providing a tobacco extract. A tobacco material and extraction solvent are provided physically separated from each other. The extraction solvent is then volatized. The tobacco material is subjected to extraction conditions by contacting the tobacco material with the volatized extraction solvent to provide a tobacco extract within the volatized extraction solvent. The extraction conditions include (i) maintaining the pressure of the tobacco material and extraction solvent at less than about 10 mm of Hg pressure and (ii) maintaining the tobacco material and extraction solvent at a temperature of greater than about 30° C. and less than the boiling point at atmospheric pressure of the volatized extraction solvent.

26 Claims, 2 Drawing Sheets

TOBACCO EXTRACTION PROCESS

BACKGROUND OF THE INVENTION

The present invention relates to extraction of tobacco components, and in particular to a process for providing a tobacco extract.

Popular smoking articles, such as cigarettes, have a substantially cylindrical rod shaped structure and include a charge of smokable material, such as shreds of strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al; 4,756,318 to Clearman et al; 4,793,365 to Sensabaugh, Jr. et al; 4,827,950 Banerjee et al; 4,893,639 to White; 4,917,128 to Clearman et al; 4,928,714 to Shannon; and 4,938,238 to Barnes et al, and propose cigarettes and pipes which comprise a fuel element, an aerosol generating means physically separate from the fuel element, and a separate mouthend piece. Such types of smoking articles are capable of providing natural tobacco flavors to the smoker thereof by heating without necessarily burning tobacco in various forms.

Natural flavors and particularly natural tobacco flavors are important components of smoking articles and provide taste and aroma to the smoking article. Thus, improved processes for providing natural flavorful and aromatic substances as well as flavorful and aromatic forms of tobacco are desirable. As a result, there has been interest in the isolation of various natural flavorful and aromatic components from natural materials such as food products (e.g., fruits), grains and tobacco. For example, the isolation of the essence of nectarines is proposed by Takeoka et al in a journal article entitled "Nectarines Volatiles: Vacuum Steam Distillation versus Headspace Sampling" in *J. Agric Food Chem.* vol. 36, pp 553–560. The extraction of hop oil is proposed by Pickett et al in a journal article entitled "Recent Developments in Low Temperature Steam Distillation of Hop Oil" in *J. Inst. Brew*, vol. 83, pp 302–304, (1977).

There has also been interest in extracting particular components from tobacco. For example, various processes for producing and using tobacco extracts, aroma oils and concentrates are proposed in U.S. Pat. Nos. 3,136,321 to Davis; 3,316,919 to Green; 3,424,171 to Rooker; 4,421,126 to Gellatly 4,506,682 to Mueller and 4,967,771 to Fagg et al., 4,986,286 to Roberts et al. and European Patent Nos. 38,831 to Clapp et al. and 326,370 to Fagg. Such materials conveniently can be applied to tobacco laminae, reconstituted tobacco sheet and other engineered tobacco materials, cigarette filters and other substrates, and the like.

It would be highly desirable to provide a tobacco extract while avoiding the necessity of subjecting a tobacco material or tobacco extract to conditions, for example, highly elevated temperatures above about 85° C., which can alter to some degree the chemical character of the tobacco material and tobacco extract, and sometimes can cause the loss of the volatile flavorful and aromatic components thereof.

SUMMARY OF THE INVENTION

The present invention relates to a process for providing a tobacco extract. A tobacco material and extraction solvent are provided physically separated from each other. The term "physically separated" relates to the tobacco material and extraction solvent not being in contact with each other prior to extraction, and any wetting of the tobacco material by the solvent (e.g., by splashing, immersion or otherwise contacting the tobacco material with a liquid solvent in a non-vapor form) is avoided. The extraction solvent is then volatized. The tobacco material is subjected to extraction conditions by contacting the tobacco material with the volatized extraction solvent to provide a tobacco extract within the extraction solvent. The extraction conditions include (i) maintaining the tobacco material and extraction solvent at less than atmospheric pressure and (ii) maintaining the tobacco material and extraction solvent at a temperature of less than the boiling point at atmospheric pressure of the volatized extraction solvent. In a preferred embodiment, the low pressure conditions can be used to volatize the extraction solvent at a temperature less than boiling point at atmospheric pressure of the extraction solvent. An advantage of this is that highly elevated temperatures (i.e., temperatures above about 85° C.) experienced by the tobacco material and the extract are avoided. These highly elevated temperatures can have the propensity to cause the loss of certain volatile flavorful and aromatic components.

For example, if water is the solvent (i.e., the volatized extraction solvent is steam), the tobacco material and steam in the extraction vessel are maintained at a pressure of less than atmospheric pressure, and preferably at a low pressure (e.g., less than about 10 mm of Hg, sometimes less than about 5 mm of Hg, often less than about 1 mm of Hg, and can be less than about 0.1 mm of Hg). The tobacco material and steam are maintained at a slightly elevated or moderately high temperature (relative to ambient temperature) of greater than about 30° C., often above about 40° C., and more often above about 45° C. while avoiding elevated temperature, namely, the temperature is maintained at less than about 85° C., often less than about 75° C. and more often less than about 65° C. The low pressures in the vessel are maintained by the continuous application of the low pressure and removal of the volatized solvent and tobacco extract carried thereby. The low pressure conditions will cause evaporation of the water to steam at a temperature of less than 100° C.

The tobacco extract carried by the solvent is then collected. Preferably, the extraction solvent is condensed to provide a condensate including the tobacco extract within the extraction solvent separate from the extracted tobacco material. The extract can be further concentrated (e.g., using a liquid-liquid extraction technique) to provide more concentrated tobacco extract within the extraction solvent.

The tobacco extract including the flavorful and aromatic tobacco-derived components thereof are useful in smoking products. For example, the tobacco extract can be applied as casing or top dressing components to tobacco strip or cut filler, as well as to other smokable materials. Alternatively, such components are useful in those types of smoking articles described in U.S. Pat. Nos. 4,708,151 to Shelar; 4,714,082 to Banerjee et al; 4,756,318 to Clearman et al; 4,793,365 to Sensabaugh et al; 4,938,236 to Banerjee et al; 4,947,874 to Brooks et al; 4,955,399 to Potter et al; and 4,991,159 to Lawrence et al, and U.S. Patent application Ser. No. 642,233 filed on Jan. 23, 1991.

The flavorful and aromatic tobacco-derived components also are useful as cigarette filter additives. For example, the flavor and aromatic components can be combined with polypropylene, polyester or low density polyethylene, and then employed as cigarette filters as described in U.S. Pat. Nos. 4,281,671 to Byrne et al and 4,862,905 to Green, Jr., et al as well as U.S. Patent application Ser. No. 606,287, filed Nov. 6, 1990. The flavorful and aromatic tobacco-derived components also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

DESCRIPTION OF THE PREFERRED EMBODIMENT

Figure 1:
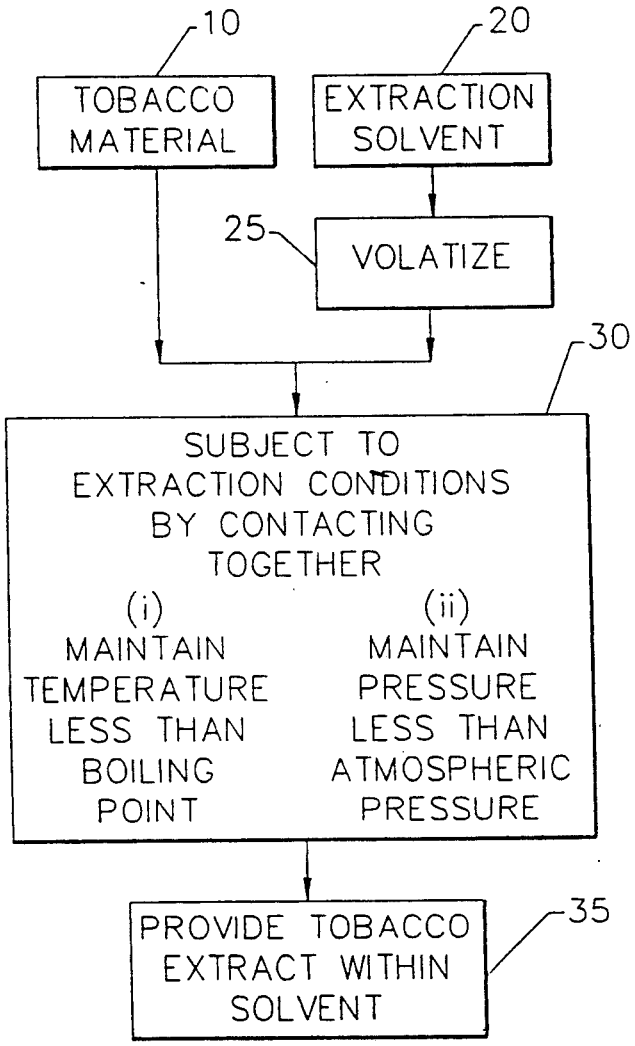
FIG. 1 is a schematic diagram of process steps representative of an embodiment of the present invention.

Referring to FIG. 1, a tobacco material 10, and an extraction solvent 20 are provided physically separate from each other. The extraction solvent 20 is volatized 25. The tobacco material 10 is subjected 30 to extraction conditions 30 by contacting the tobacco material with the volatized extraction solvent to provide a tobacco extract 35 within the volatized extraction solvent. The extraction conditions include (i) maintaining the tobacco material and extraction solvent at a pressure less than about 10 mm of Hg and (ii) maintaining the tobacco material and extraction solvent at a temperature of greater than about 30° C. and less than the boiling point of the extraction solvent at atmospheric pressure. The low pressure conditions can be used to volatize the extraction solvent at temperatures lower than the boiling point at atmospheric pressure thereof, and preferably lower than about 85° C.

Figure 2:
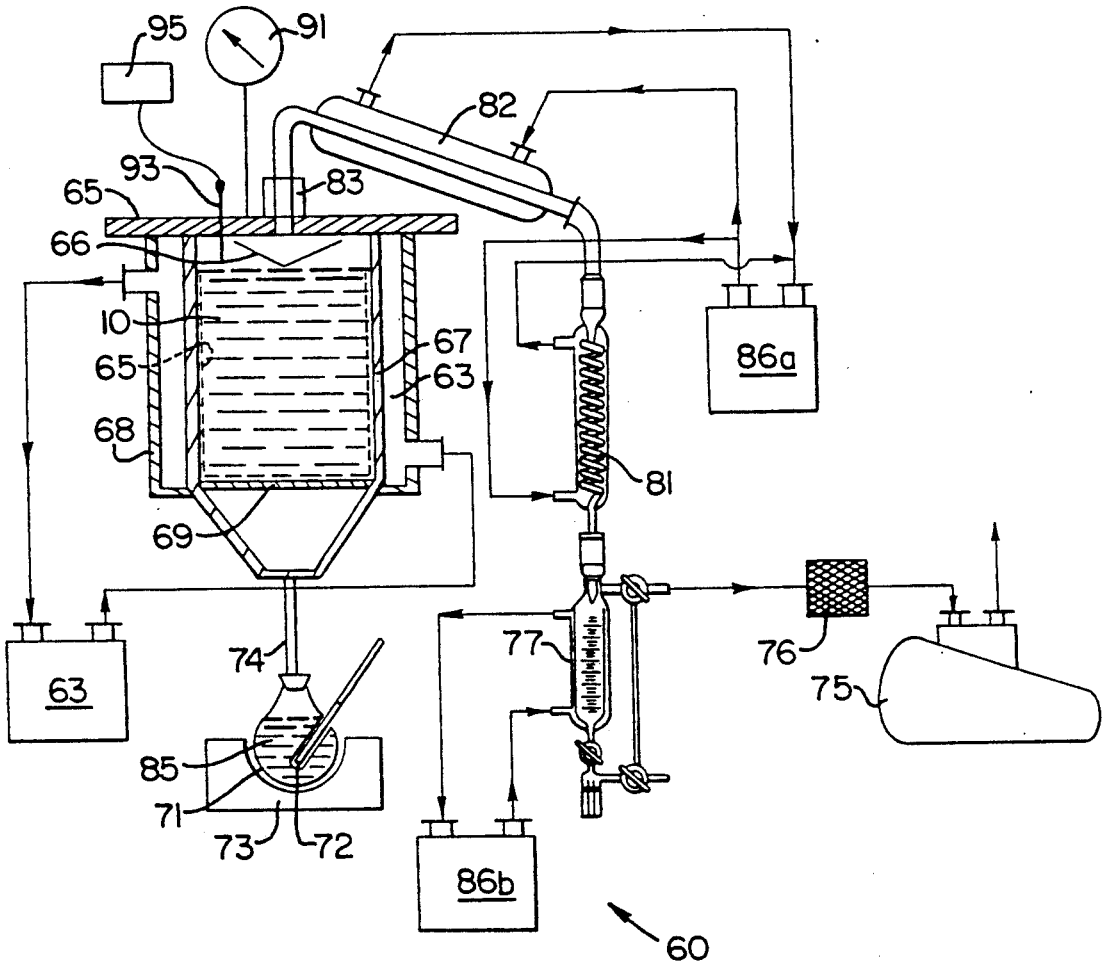
FIG. 2 is a schematic diagram of a representative apparatus for performing the process of this invention.

Referring to FIG. 2, an apparatus 60 useful in the present invention is shown. The apparatus 60 includes an extraction vessel 63 or other means for extracting the tobacco material. Preferably, the extraction vessel 63 includes a wire mesh screen basket 65 positioned within the extraction vessel 63, and a heating jacket 67 lining the vertically surrounding walls 68 of the vessel 63, and a bottom screen 69 positioned horizontally therein. The heat jacket 63 is connected to a liquid (e.g. water, propylene glycol, etc.) constant temperature bath 67 to maintain the desired temperature. The vessel 63 also includes a flange 65 and a baffle 66. A boiling flask 71 is placed in a heating mantle 73 or other heating means for the raising the temperature of the tobacco material 10 or extraction solvent. The flask 71 is positioned below the extraction vessel 63 and can include a thermometer 72 for monitoring the temperature.

A vacuum pump 75 or other means for reducing the pressure of the system reduces the pressure to less than atmospheric pressure, preferably less than about 10 mm of Hg, sometimes less than about 5 mm of Hg, often less than about 1 mm, more often less than 0.5 mm of Hg, and can be less than about 0.1 mm of Hg. An exemplary vacuum pump 75 is model D-150 from Fisher Scientific Inc. The vacuum pump 75 is connected via a suitable adaptor including vacuum inlet filter 76 such as model CV-0118-30 from Balston Filter Products, to condensation and collection means. Exemplary condensation means can include a jacketed receiver 77 available as catalog #6642, Ace Glass, Inc., which is connected to the extraction vessel 63 through a Graham-type condenser 81 and a distilling head 82 via a stainless steel adaptor 83. The temperatures within each of the condenser 81 and distilling head 82 provide cooling. The temperatures are maintained at a temperature of from about 0° C. to about 10° C. by constant temperature baths **86*a*,86*b*. The pressure and temperature conditions in the extraction vessel 63 are monitored using a vacuum gauge 91 and a thermocouple 93 with a temperature readout 95 or other means for monitoring the pressure and temperature. The pressure and temperature are maintained by the continuous removal of the extract within the solvent from the vessel 63. The heating mantle 73 and the vacuum pump 75** provide a temperature and pressure environment suitable for providing a volatilized extraction solvent capable of extracting the tobacco material at temperatures below about 85° C.

In operation, tobacco material 10 having a initial moisture content of at least about 10 percent, and often greater than about 15 percent, is placed in the extraction vessel 63 physically separate from the extraction solvent. The solvent from the boiling flask 71 (e.g., water) is volatized and the tobacco material in the extraction vessel 63 is heated to increase the vapor pressure of the desired volatile flavorful components of the tobacco material. The tobacco material in the vessel and the extraction solvent are maintained at a slightly elevated temperature (relative to ambient temperature) of greater than about 30° C., often greater than about 40° C., and more often above about 45° C., while avoiding elevated temperatures, namely, the temperature is maintained at less than about 85° C., often less than about 75° C. and more often less than about 65° C. A vacuum can be pulled to increase the vapor pressure of the solvent while maintaining the solvent as a warm vapor. Each of the solvent and the tobacco material can be maintained at different temperatures during the tobacco extraction process steps. A vacuum is applied using the vacuum pump 75. The pressure is reduced to less than atmospheric pressure, preferably less than about 10 mm of Hg, sometimes less than about 5 mm of Hg, often less than about 1 mm,.more often less than 0.5 mm of Hg, and can be less than about 0.1 mm of Hg. The low pressure conditions tend to volatize the extraction solvent at a temperature lower than the ambient pressure boiling point of the solvent. The volatized extraction solvent is then allowed to be uniformly distributed through the tobacco material.

The volatized extraction solvent, after passing through the tobacco material and thus contacting the tobacco material, contains the tobacco extract therewithin. Preferably, the extraction solvent is cooled and condensed using the distilling head 82 and condenser 81 which are maintained at a temperature of less than about 5° C., preferably less than about 2° C., and often less than about 1° C., but preferably above the freezing point of the solvent. The resulting condensate including the tobacco extract within the solvent is collected in the receiver 77. The condensate can be concentrated using a liquid-liquid extraction technique (e.g., using dimethyl ether and the like) or can be concentrated using any of the concentration techniques known to those skilled in the art.

The tobacco materials useful herein can vary. Tobacco materials which are used are of a form such that under extraction conditions, a portion thereof is soluble in extracted by an extraction solvent; and a portion thereof is not extracted by that extraction solvent. A typical portion that is not extracted includes components of the biopolymer matrix of the tobacco.

Examples of suitable types of tobacco materials include flue-cured, Burley, Md. and Oriental tobaccos, as well as the rare or specialty tobaccos. The tobacco material generally has been aged, and can be in the form of laminae and/or stem, or can be in processed form, or can be in ground or milled form. Tobacco waste materials and processing or ground or milled film by-products such as fines, dust, scrap, stems and stalks can be employed. Unaged, uncured mature, or immature tobaccos also can be employed. The aforementioned tobacco materials can be processed separately, or as blends thereof.

The extraction solvent is preferably a liquid having an aqueous character. Such a liquid consists primarily of water, normally greater than about 90 weight percent water, and can be essentially pure water in certain circumstances. For example, an essentially pure water can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent or azeotropic mixture of water and minor amounts of one or more solvents which are miscible therewith. The selection and use of other solvents and the selection and use of different pressure and temperature conditions are within the skill of one in the art.

A wide variety of components can be extracted from the tobacco material. The particular components and the amounts of the particular components which are extracted often depend upon the type of tobacco material which is processed. Typically, at least about 0.02 percent, frequently at least about 0.03 percent, more often at least about 0.05 percent, and can be at least about 0.10 percent or more of the weight of the starting tobacco material (on a dry weight basis) is extracted and the extract removed from the extracted tobacco material. Pure water extraction solvent will most often extract primarily of the water soluble components of the tobacco material the extract includes organic acids, alcohols, aldehydes, esters, ethers, lactones, ketones and other hydrocarbons, and nitrogen-containing compounds including tobacco alkaloids and phenols. These compounds are the flavorful and aromatic components of tobacco material.

In another embodiment, the extraction solvent or tobacco material can be pretreated and contacted with a strong base (e.g. ammoniated) to increase nicotine extraction or can be contacted with a strong acid (organic or inorganic) to decrease nicotine extraction. Additionally, the extract can be stored by refrigeration.

The tobacco extract and the collected flavorful and aromatic tobacco-derived components derived from further treatment thereof are used in various forms in the manufacture of smoking articles. For example, the tobacco-derived components can be contacted with tobacco and employed as a form of tobacco in smoking article manufacture. For example, tobacco cut filler, as well as the types of smokable materials described in U.S. Pat. No. 4,920,990 to Lawrence et al, the disclosure of which is incorporated herein by reference, can be coated or otherwise blended with about 0.001 to about 1 percent by weight of the flavorful and aromatic tobacco-derived components, based on the weight of the particular smokable material. Furthermore, the tobacco extract may be combined with aerosol forming materials, and employed in the manufacture of those smoking articles described in U.S. Pat. Nos. 4,708,151 to Shelar; 4,714,082 to Banerjee et al; 4,756,318 to Clearman et al; 4,771,795 to White et al; 4,793,365 to Sensabaugh et al; 4,917,128 to Clearman et al; 4,938,236 to Banerjee et al; and 4,947,874 to Brooks et al; 4,955,399 to Potter et al; and 4,991,159 to Lawrence et al; the disclosures of which are incorporated herein by reference. In addition, the coated tobacco can be incorporated into those smoking articles described in U.S. Patent application Ser. No. 414,833 filed Sep. 29, 1989 and European Patent Publication No. 280,990, the disclosures of which are incorporated herein by reference.

The extracted tobacco material can be reformed, cut to a desired size or shape, or otherwise physically treated, particularly when the extracted tobacco material is in a fairly moist form. In particular, the extracted tobacco material can be treated by a volume expansion process such as described in U.S. Ser. No. 505,339 to Poindexter et al filed Apr. 5, 1990, the disclosure of which is incorporated herein by reference. The extracted tobacco material can be further extracted using a liquid having an aqueous character, heat treated or otherwise physically processed to change the chemical composition of that material. In particular, the extracted tobacco material can be subjected to enzyme treatment (as set forth in U.S. Pat. No. 4,887,618 to Bernasek et al, the disclosure of which is incorporated herein by reference), reacted with certain agents or fermented, further extracted (e.g., an extracted tobacco material provided from an extraction of a tobacco material with an aqueous solvent can be subjected to extraction conditions using a hydrophobic solvent, such as hexane).

The extracted tobacco material can be deproteinized and reapplied to the extracted tobacco material. The extracted tobacco material can also be combined with the tobacco extract within the solvent to provide certain types of processed tobacco materials, (e.g., reconstituted filler material). Additionally, the extracted tobacco material can be combined at later stages with the tobacco extract of the present invention.

The following example is provided in order to further illustrate various embodiments of the invention but should not be construed as limiting the scope thereof. Unless otherwise noted, all parts and percentages are by weight.

EXAMPLE

The example is performed using the apparatus shown in FIG. 2. About 910 g (dry weight basis) sample of aged flue-cured tobacco in cut filler form having about a 19 percent moisture content is placed in the screen basket 65 positioned in the extraction vessel 63. The tobacco material 10 is preheated under ambient conditions to about 65° C. to increase the vapor pressure of the flavorful and aromatic components of the tobacco material.

About 1 liter of distilled water is used as the extraction solvent. The distilled water extraction solvent is volatized during the extraction by reducing the pressure of the system using vacuum pump 75 and maintained as a warm vapor by heating the distilled water to about 26° C. to about 27° C. The volatized distilled water (i.e., steam) is uniformly distributed through the tobacco material and is continuously removed from the extraction vessel 63.

The extract within the steam is collected by cooling the distilling head 82 and condenser 81 to about 1° C. to condense the steam. The extract within the condensed steam is collected in the receiver 77 as three separate 250 ml samples of extract within the solvent. The extraction takes a total of about 50 minutes. The first collection of extract has a strong tobacco aroma, the second collection has a medium tobacco aroma and the third collection has a weak tobacco aroma. The three collections of extract within the water are combined. The combined sample is clear, has a slightly yellowish tint, and has about 0.3 g parts of flavorful and aromatic components per weight contained therein.

The combined sample of liquid extract is refrigerated for storage and later concentrated by subjecting it to liquid-liquid extraction steps using dimethyl ether. The dimethyl ether portion is collected and the dimethyl ether is evaporated yielding a concentrated extract. The concentrated extract has a strong tobacco aroma and has a higher viscosity than the unconcentrated extract.

The concentrated extract is contacted with ethyl alcohol, and the resulting extract applied to an American blend of tobacco cut filler as a top dressing component of a cigarette. The cut filler is the smokable material of the cigarette. The cigarette is smoked and yields tobacco flavor, as well as a non-bitter taste, and has a sweet fruity aroma.

That which is claimed is:

1. A process for providing a tobacco extract, the process comprising:

(a) providing a tobacco material and an extraction solvent physically separate from each other;

(b) volatizing the extraction solvent; and (c) subjecting the tobacco material to extraction condition by contacting the tobacco material with the volatized extraction solvent to provide a tobacco extract within the volatized extraction solvent, the extraction conditions including (i) maintaining the pressure of the tobacco material and extraction solvent at less than 10 mm of Hg and (ii) maintaining the tobacco material and extraction solvent at a temperature of greater than 30° C. and less than the boiling point at atmospheric pressure of the extraction solvent.

2. A process according to claim 1 whereby the tobacco material is provided such that the moisture content thereof prior to step (b) is at least about 15 percent by weight.

3. A process according to claim 1 whereby the tobacco material is contacted with an acid or with a base prior to step (b).

4. A process according to claim 1 whereby the extraction solvent is contacted with an acid or with a base prior to step (b).

5. A process according to claim 1 whereby the tobacco extract is concentrated using a liquid-liquid extraction technique.

6. A process according to claim 1 whereby the extraction solvent is a liquid having an aqueous character.

7. A process according to claim 1 whereby the pressure of the tobacco material and extraction solvent is maintained at a pressure of less than about 1 mm of Hg during the extraction conditions of step (c).

8. A process according to claim 1 whereby the pressure of the tobacco material and extraction solvent is maintained at a pressure of less than about 0.5 mm of Hg.

9. A process according to claim 1 further comprising subjecting the tobacco extract to further treatment to provide tobacco-derived components of the tobacco extract.

10. A process for providing a processed tobacco extract, the process comprising:

(a) providing a tobacco material and an extraction solvent physically separate from each other;

(b) volatizing the extraction solvent;

(c) subjecting the tobacco material to extraction condition by contacting the tobacco material with the volatized extraction solvent to provide a tobacco extract within the volatized extraction solvent, the extraction conditions including (i) maintaining the pressure of the tobacco material and extraction solvent at less than about 10 mm of Hg and (ii) maintaining the tobacco material and extraction solvent at a temperature of greater than 30° C. and less than the boiling point at atmospheric pressure of the volatized extraction solvent;

(d) condensing the extraction solvent within the volatized extraction solvent to provide a condensate; and (e) collecting the condensate including the tobacco extract within the extraction solvent.

11. A process according to claim 10 whereby the tobacco material is provided such that the moisture content thereof prior to step (b) is at least about 15 percent by weight.

12. A process according to claim 10 whereby the tobacco material is contacted with an acid or a base prior to step (b).

13. A process according to claim 10 further comprising subjecting the tobacco extract to further treatment to provide tobacco-derived components of the tobacco extract.

14. A process according to claim 10 whereby the extraction solvent is contacted with an acid or a base prior to step (b).

15. A process according to claim 10 whereby the tobacco extract is concentrated using a liquid-liquid extraction technique.

16. A process according to claim 10 whereby the pressure of the tobacco material and extraction solvent is maintained at a pressure of less than about 1 mm of Hg during the extraction conditions of step (c).

17. A process according to claim 10 whereby the pressure of the tobacco material and extraction solvent is maintained at a pressure of less than about 0.5 mm of Hg.

18. A process for providing a tobacco extract, the process comprising:

(a) providing a tobacco material and an extraction solvent physically separate from each other;

(b) volatizing the extraction solvent; and (c) subjecting the tobacco material to extraction condition by contacting the tobacco material with the volatized extraction solvent to provide a tobacco extract within the volatized extraction solvent, the extraction conditions including (i) maintaining the pressure of the tobacco material and extraction solvent at less than atmospheric pressure and (ii) maintaining the tobacco material and extraction solvent at a temperature of from about 35° C. to about 75° C.

19. A process according to claim 18 whereby the tobacco material is provided such that the moisture content thereof prior to step (b) is at least about 15 percent by weight.

20. A process according to claim 18 whereby the tobacco material is contacted with an acid or with a base prior to step (b).

21. A process according to claim 18 whereby the extraction solvent is contacted with an acid or with a base prior to step (b).

22. A process according to claim 18 whereby the tobacco extract is concentrated using a liquid-liquid extraction technique.

23. A process according to claim 18 whereby the extraction solvent is a liquid having an aqueous character.

24. A process according to claim 18 whereby the pressure of the tobacco material and extraction solvent is maintained at a pressure of less than about 1 mm of Hg during the extraction conditions of step (c).

25. A process according to claim 18 whereby the pressure of the tobacco material and extraction solvent is maintained at a pressure of less than about 0.5 mm of Hg.

26. A process according to claim 18 further comprising subjecting the tobacco extract to further treatment to provide tobacco-derived components of the tobacco extract.

* * * * *